United States Patent [19]

Stahlecker et al.

[11] 4,172,357

[45] Oct. 30, 1979

[54] PROCESS AND APPARATUS FOR PIECING A YARN ON SPINNING ASSEMBLIES OF AN OPEN-END SPINNING MACHINE

[76] Inventors: Fritz Stahlecker, Josef-Neidhart-Strasse 18, 7341 Bad Überkingen; Hans Stahlecker, Haldenstrasse 20, 7334 Süssen, both of Fed. Rep. of Germany

[21] Appl. No.: 879,738

[22] Filed: Feb. 21, 1978

[30] Foreign Application Priority Data

Mar. 2, 1977 [DE] Fed. Rep. of Germany ..... 2708936

[51] Int. Cl.[2] ..... D01H 15/00

[52] U.S. Cl. ..... 57/263; 57/78

[58] Field of Search ..... 57/34 R, 58.89–58.95, 57/78, 156, 263

[56] References Cited

U.S. PATENT DOCUMENTS

| | | | |
|---|---|---|---|
| 3,704,579 | 12/1972 | Tooka et al. | 57/34 R |
| 3,760,576 | 9/1973 | Le Chatelier et al. | 57/34 R |
| 3,780,513 | 12/1973 | Wanatabe et al. | 57/58.89 X |
| 3,791,128 | 2/1974 | Landwehrkamp et al. | 57/58.89 X |
| 4,059,946 | 11/1977 | Bottcher et al. | 57/34 R |
| 4,080,775 | 3/1978 | Stahlecker | 57/34 R |

*Primary Examiner*—Charles Gorenstein

*Attorney, Agent, or Firm*—Craig and Antonelli

[57] ABSTRACT

A process and apparatus for piecing a yarn on spinning assemblies of an open end spinning machine is provided. A prepared yarn end is pieced to a sliver ring produced in a spinning rotor during running up of the spinning rotor from a predetermined slower speed toward its operational normal spinning speed. In order to accommodate application of the yarn end to the sliver ring, the formation of the sliver ring, and the drawing off of new yarn pieced together at the sliver ring, the invention provides for a control of the acceleration behavior of the spinning rotor so as to lengthen the time segment in which the piecing steps can be performed. In preferred embodiments, non-contact electromagnet or electrical eddy current braking means are provided for countering the driving torque of a common drive means for the rotors of several spinning assemblies, whereby the acceleration curve is flattened with a lengthening of the time period for existent desirable piecing speeds. In other preferred embodiments, inter-exchangeable spinning rotors of different diameters are provided with similar mass moments of inertia so as to exhibit similar flattened acceleration curves, even for very small diameter spinning rotors. In other preferred embodiments, driving mechanisms and/or braking mechanisms for the spinning rotor shafts are provided for controlling the running up or acceleration behavior.

36 Claims, 17 Drawing Figures

50
51
48
46
1
67
68
69
32
33
75
72
71
76
74
73
70
65
66
79
31
30
29
42
78
77
80
2
5
23
3
7
8
4
11
10
9
60
63
62
43
41
44
24
61
34
26
25
35
64
54
55
56
57
53
49
22
58
59
20
15
39
40
27
28
37
36
38
21
16
14
12
13
19
18
6
52
47
45

PROCESS AND APPARATUS FOR PIECING A YARN ON SPINNING ASSEMBLIES OF AN OPEN-END SPINNING MACHINE

BACKGROUND AND SUMMARY OF THE INVENTION

The invention concerns a process for piecing a yarn on spinning assemblies of an open end spinning machine, and an open end spinning machine for execution of the process, in which a yarn end taken from a winding spool for the previously spun yarn is prepared for a piecing process, guided back into a spinning rotor, applied to a ring of silver that is present there, and again drawn off as new yarn, whereby the production of the silver ring in the spinning rotor, the application to this ring, and the drawing off of the new yarn occur before the previously braked spinning rotor reaches it operational rpm.

From German OS No. 2,321,775 (corresponding to U.S. Pat. No. 3,892,062), it is known that in an open end spinning machine, piecing can be effected by means of a mobile piecing device in which the control means for the devices that execute the piecing are adjusted to each other temporally, and to the running up phase of the previously braked spinning rotor, so that application and new drawing off of the yarn is effected during the running up curve of the spinning rotor. Here the circumstance is exploited that in running up, the spinning rotor passes through an rpm (rotational speed—revolutions per minute) range that is especially suitable for piecing, and this range is utilized for the piecing operation. Here there is the advantage that without a regulation of the rpm, and without reduction of the rpm of the whole spinning machine, a piecing operation can be effected at an advantageous rpm although the operational rpm may be distinctly higher.

In practice it has turned out that there are difficulties which are caused primarily by the switching and actuating times of the individual elements. These problems come up particularly in the case of small, correspondingly light spinning rotors. The invention concerns the problem of creating a process of the specified kind, whereby it will be possible to make available the necessary switching and actuating times for the individual steps of the piecing operation without the need for new types of drives or the like for the spinning assembly. The problem is solved in that the running up behavior of the spinning rotor is influenced so as to lengthen the time segment in which suitable rpm's of the rotor prevail for a piecing operation.

With this arrangement, there is more time for all work steps during the piecing process so that they do not hamper each other, and the most favorable conditions for piecing can be utilized.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
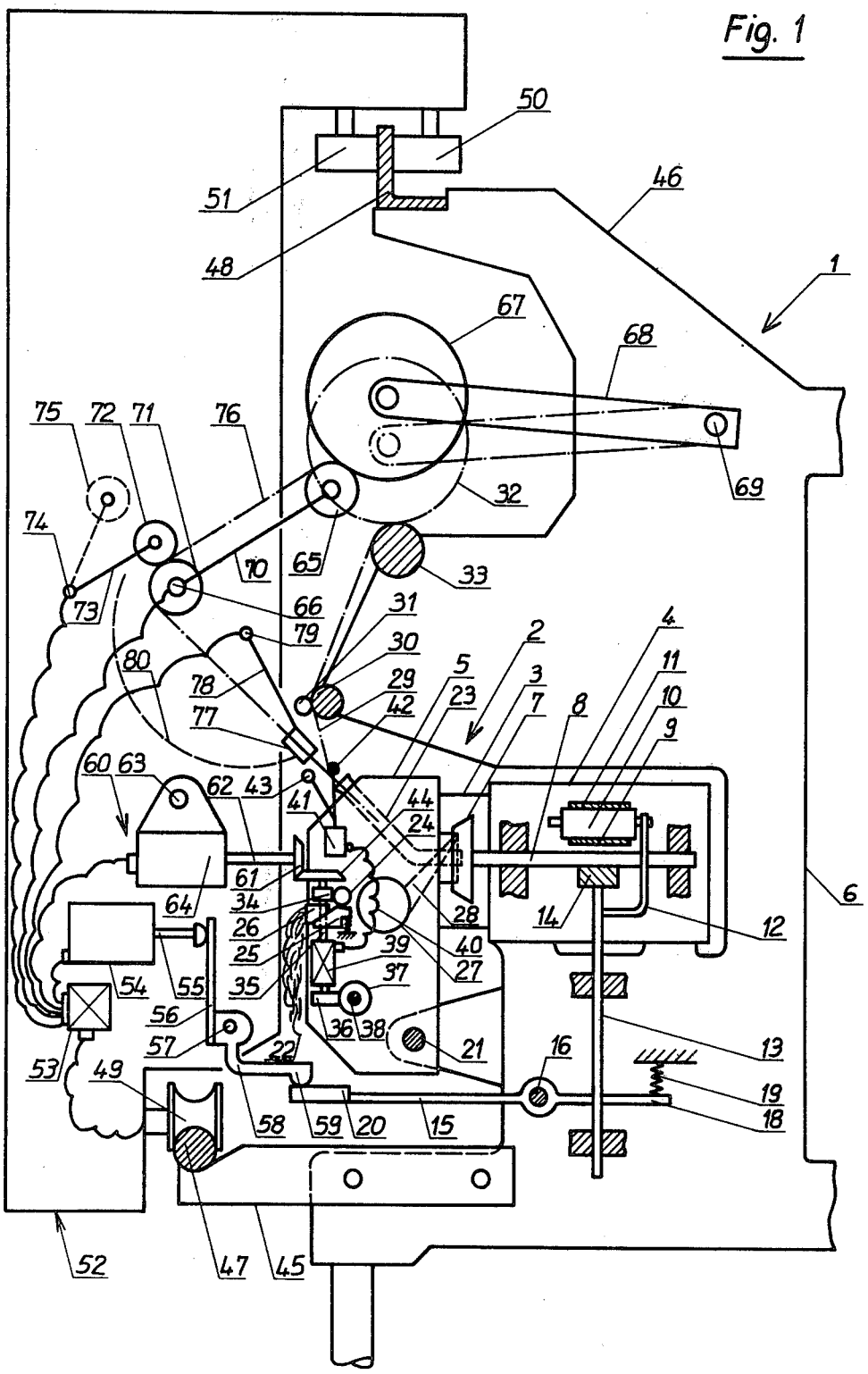
FIG. 1 is a cross-sectional schematic view through an open end spinning machine in the region of a spinning assembly, and a mobile servicing instrument presented to the said assembly, to execute a piecing operation, in accordance with a preferred embodiment of the invention.

In FIG. 1, an open end spinning machine 1 is schematically shown in cross section, in the region of a spinning assembly 2 which consists of a plurality of such spinning assemblies disposed next to each other. Each spinning assembly presents essentially three housings 3, 4 and 5 fixed to a machine frame 6. Housing 3 is connected to a vacuum source, and accepts a spinning rotor 7. Shaft 8 of spinning rotor 7 is borne in housing 4 and in the operational state it is driven by a tangential belt 9. Said tangential belt 9 in the operational state is pressed by a pressure roll 10 on shaft 8 which also guides the return strand 11 of tangential belt 9. In the state illustrated in FIG. 1, in which spinning rotor 7 is still, pressure roll 10 and thereby driving tangential belt 9, are lifted off rotor shaft 8. For this, pressure roll 10 is connected via a rod 12 with a brake mechanism 13, which has a brake cheek 14 that in FIG. 1 is presented to rotor shat 8. Brake mechanism 13 is coupled with a double armed brake lever 15 which can be swung about a stationary shaft 16. In the operational state, the rear arm 18 of brake lever 15 is pressed downward by a spring 19, whereby brake mechanism 13 moves downward, and moves brake cheek 14 from rotor shaft 8. At the same time, because of a coupling of rod 12 with brake mechanism 13, pressure roll 10 is lowered and thereby tangential belt 9 is applied to rotor shaft 8. The forward arm of brake lever 15 has a contact piece 20 by which the whole brake mechanism is actuatable.

There is a stationary shaft 21 on machine frame 6, about which housing 5 of spinning assembly 2 can be swung down from housing 3. In this way if need be, spinning rotor 7 is laid open and made accessible from the outside. Housing 5 which can be swung down contains essentially the feed and opening devices for sliver 22 which is to be spun, as well as a yarn take off passage 23. The feed device, in a known way, has a feed roll 24, a feed table 25 cooperating therewith and urged by a spring, as well as an intake hopper 26 for sliver 22. Sliver 22 which is clamped along a nip between feed roll 24 and feed table 25 presents a sliver beard to a fast-running opening roll 27. Opening roll 27 opens the sliver in a known way, to form individual fibers which are delivered via a feed passage 28 to spinning rotor 7, and there it is spun in a known way to form a yarn 29. The spun yarn 29, shown as a dot-and-dash line, is drawn off by rolls 30 and 31 from take off passage 23 and wound on a spool 32 which is likewise indicated by dot-and-dash lines, said spool being driven by a friction roll 33.

The drive for feed roll 24 is effected via a gear 34 which is connected with another gear 36 via an upright shaft 35; gear 36 engages a gear 37. Gear 37 is connected so as to be fixed in rotation with a driven shaft 38 extending in the longitudinal direction of the machine. Between gears 34 and 36 there is an electromagnetic coupling 39, connected via an electric lead 40 with a yarn monitor 41. Yarn monitor 41 has a yarn sensor 42 which monitors the presence of yarn 29 and is deflected into position 43 if there is a break. In that case, yarn monitor 41 interrupts the drive of feed roll 24 via electromagnetic coupling 39 which, although gear 36 is driven as before, stops gear 34 and therewith feed roll 24. On upright shaft 35 of the drive for feed roll 24, there is a tapered gear 44 which extends forward somewhat beyond housing 5, via which gear the feed can be briefly actuated from the outside during a piecing process, as will be described in more detail below.

On machine frame 6 there are rails 47 and 48 extending with brackets 45, 46 in the longitudinal direction of the machine. On these rails 47, 48, a servicing instrument 52 can be moved along open end machine 1, on rollers 49, 50 and 51. The weight of servicing instrument 52 is preferably received by two rollers 49, whereof at least one is driven. Rollers 50 and 51 serve to stabilize servicing instrument 52 horizontally.

Mobile servicing instrument 52 includes means or function elements for piecing, preferably to eliminate a yarn break: only some of these means are shown in FIG. 1. Servicing instrument 52 has among other things a program control 53 which is electrically connected with the travel mechanism and also with several individual drives for the individual function elements. One of these connections comprises an actuating element 54, shown as a lifting piston magnet, whose piston 55 can be applied against a lever 56 on servicing piecing device 52, the said lever being swingable about a shaft 57. An actuating arm 58 is fixed in rotation with lever 56, its contact piece 59 being able to actuate the forward contact piece 20 of the brake mechanism of spinning rotor 7. In the case illustrated in FIG. 1, piston 55 of actuating element 54 has been moved out and has pushed lever 56 to the right, whereby contact piece 59 has been moved downward. Hereby contact piece 20 of brake lever 15 has been moved downward, whereby brake cheek 14 is applied against rotor shaft 8, and further the tangential belt 9 has been lifted off from rotor shaft 8. Spinning rotor 7 is thus temporarily braked. If, controlled by program control 53, piston 55 of actuating element 54 is pushed back toward the left, brake lever 15 (by the action of spring 19) will again be moved upward, whereby brake 14 will release rotor shaft 8, and tangential belt 9 will once more be applied to rotor shaft 8. Actuating element 54, controlled by program control 53, then triggers the starting time for running up spinning rotor 7, and at the same time it triggers the actual piecing operation.

So long as the yarn sensor remains in its inoperative position 43, feed roll 24 is stopped. For this reason, a drive 60 for mobile servicing instrument 52 is provided which has a tapered gear 61 that can be brought into engagement with the previously described tapered gear 44 of spinning assembly 2. Tapered gear 61 is seated on a shaft 62 which can be temporarily driven, including intermittently with interruptions, by a motor 64 that is swingable about a shaft 63. By this arrangement feed roll 24 of piecing device 52 can be driven so long as the yarn sensor is in its inoperative position 43. When servicing instrument 52 is not executing a piecing operation, tapered gear 61 is swung out somewhat upward, so that engagement with tapered gear 44 is interrupted.

Servicing instrument 52 further has a lift off roll 65 that is swingable about a shaft 66. Lift off roll 65 can be applied from below against spool 32 and lift it from friction roll 33 into raised position 67. Spool 32 (67) is held by a spool arm 68 which is swingable about a shaft 69 that is fixed to the machine. Lift off roll 65 is disposed on a lever 70 which also bears an auxiliary draw off roll 71 on its shaft 66 which roll 71 can be driven in either direction, preferably synchronously with lift off roll 65. Auxiliary draw off roll 71 cooperates with a pressure roll 72 which can be swung via a lever 73 about a shaft 74 into a raised position 75. This raised position 75 makes it possible to insert yarn end 76 that is to be wound off from lifted spool 67 (32) and pieced, between draw off rolls 71 (75) by a swingable suction device that is not illustrated. The pressure roll (72, 75) subsequently assumes position 72 whereby yarn end 76 that is to be pieced, which is thus guided into servicing instrument 52, can be delivered back to yarn take off passage 23. This happens with cooperation of a yarn transfer clamp 77 whose pivot arm 78 is rotatable about a shaft 79. Yarn transfer clamp 77 can swing along radius (path) 80 which is indicated by dashed lines.

Before yarn end 76 can be guided back into the spinning rotor and drawn off again as newly spun yarn, a sliver ring has to be built in spinning rotor 7, to which yarn end 76 will be presented. Production of this sliver ring is controlled during piecing by drive 60 of servicing instrument 52, and sustained until the yarn sensor of yarn monitor 41 assumes its operative position and therewith the device for sliver feed to spinning assembly 2 in question has been switched on. Servicing instrument 52 generally also has a number of other function elements whereby the guided back yarn end is prepared before the actual piecing process and whereby the subsequently controlled transfer of the drawn off yarn to the spinning assembly is effected. Program control 53 of mobile servicing instrument 52 determines the succession and course of the individual process steps that are necessary for the piecing, until the yarn ultimately is transferred once more to the spinning assembly.

Spinning machines today work at 70,000 $min^{-1}$ (revolutions per minute—rpm's) and more. Since it is not practical to execute a piecing process at such high speeds, it is provided that during the piecing there will be lower rpm's. Here it is advantageous if the circumstance can be exploited that spinning rotor 7, in running up from a previously braked state, passes through a specific speed range that is particularly suitable for a piecing operation. Since open end spinning machines in general are such that the spinning rotors can be braked independently of the spinning rotors of adjacent assemblies, it suffices for the whole intervention of servicing instrument 52, in the construction of open end spinning assembly 2, that there be the possibility of actuating the brake mechanism of spinning rotor 7, and that for a specific time the feed of sliver be taken over via drive 60. The functioning of the servicing instrument is thereby independent of the type of drive for the spinning rotor, and its bearings. Changes and ancillary devices on the individual spinning assemblies are at a minimum. All function elements that are essential for the piecing operation are disposed in the servicing instrument, so that they merely have to be available in the servicing instrument and need not be duplicated for the individual spinning assemblies.

Since spinning rotors in general run up relatively fast to their operating rpm, there is only a relatively short time available. For this reason, the arrangement is such that only those work steps are executed during high-speed running that depend upon the rpm of spinning rotor 7. This means that the preparatory steps, namely the drawing off of the yarn from spool 67, the possibly necessary preparation of the yarn end, and the guiding of the yarn into the region of yarn take off passage 23 are controlled by program control 53 in such a way that these steps are executed when the brake mechanism of the spinning rotors is released by program control 53, so that the start signal for running up spinning rotor 7 is given. During the running up of the spinning rotor, a sliver ring must be laid in the rotor, and this is managed by the feed for sliver 22 controlled by servicing instrument 52. This feed can occur only if the spinning rotor has attained a minimum speed because otherwise the centrifugal force acting on the sliver inside the spinning rotor will not be sufficient to hold the sliver against the suction air flow inside rotor housing 3. Unless an exactly determined amount of fibers forms the sliver ring that is needed for piecing, the piecing will be very inhomogeneous. During the running up moreover, the yarn end must be presented to the sliver ring, and it must then be drawn off again as spun yarn. Both processes are controlled by program control 53, whereby application of the yarn end onto the sliver ring occurs after a predetermined time, whereas the drawing off again can be time-dependent or it can be controlled by a yarn sensor in the yarn path of servicing instrument 52.

Although program control 53 can determine the individual switching steps very exactly in time, there are certain tolerances that are caused by the inertia of the switching elements, especially the mechanical switching elements and the individual actuations. These deviations can be taken into account on the function elements of servicing instrument 52, by appropriate adjustments. In this way, servicing instrument 52 itself works with practically uniform conditions. The structural parts on the devices of the individual spinning assemblies 2 that are to be actuated in piecing cannot be adjusted so that certain deviations will not occur from one spinning station to the next. This applies especially to the brake system that brakes spinning rotor 7. It has to be assumed that in release of the rotor brake there will be differences between the individual spinning assemblies.

Figure 2:
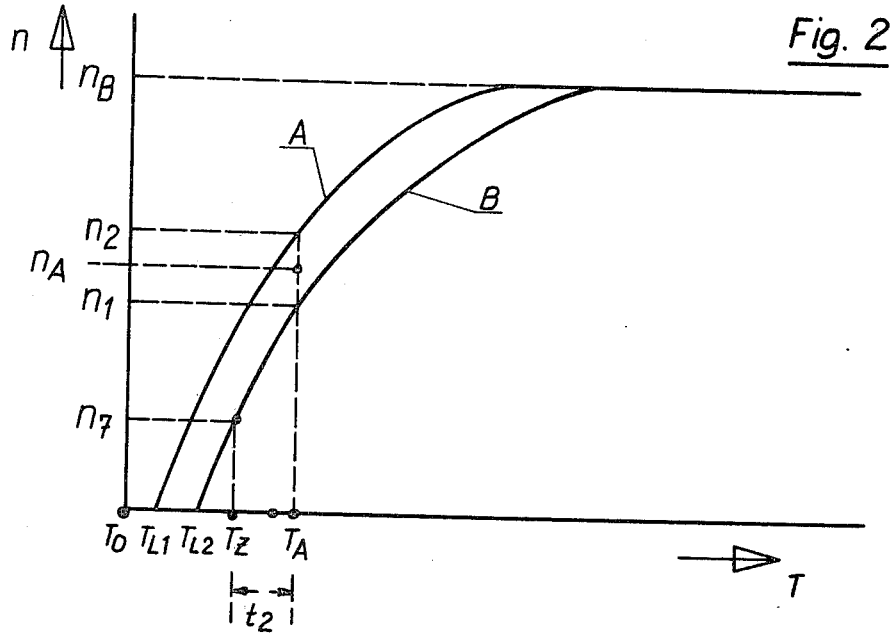
FIG. 2 is a diagram which schematically shows the running up behavior of a spinning rotor starting from a stop.

These deviations are illustrated in FIG. 2. It is assumed that program control 53 gives the signal to release the brake of spinning rotor 7 at time $T_0$. In a spinning assembly then, the actual brake release and therewith the beginning of the running up process of the spinning rotor will occur at time $T_{L1}$ while in the case of another assembly this will only happen at time $T_{L2}$. The possible deviations in the running up behavior of the spinning rotors of the individual spinning assemblies 2 can therefore be represented by two parallel curves A and B, with which the spinning rotor runs up to its operating rpm $n_B$. In this figure it is assumed that the running up behavior of spinning rotor 7 after release of the brake is the same on the individual spinning assemblies 2. If this assumption were not correct, the effect would be that the area between curves A and B would be wider, since still greater tolerances would occur.

In the diagram in which the rotor speed is plotted over time T, the most favorable piecing rpm $n_A$, which is known from experiment, can be drawn in, designating the speed at which the yarn end should be applied to the sliver ring in spinning rotor 7. A piecing time $T_A$ correlated with this speed is marked on the curve. This piecing time $T_A$ is an average, so that in practice the piecing time may be at rpm $n_1$ and $n_2$ instead of $n_A$, deviating upward or downward from that value.

As already mentioned, there has to be a specific rotor speed $n_z$ if the feed is to occur whereby sliver will be delivered to spinning rotor 7, forming the sliver ring to which the yarn end is to be applied. Since this refers to a minimum rpm, feed time $T_Z$ must be determined by outer curve B which represents the greater deviation.

For execution of the feed, a certain time interval will be needed after time $T_Z$ so that a sliver ring of a quite specific configuration may be produced. This ring must be uniform, so that the most regular possible piecing will result. Only after the so-called preliminary feed has been completed and the sliver ring has been formed, can the actual piecing or presentation of the yarn end on the sliver ring occur. If now spinning rotor 7 is running up very rapidly, it may happen that time interval $t_2$ between the beginning of the feed $T_Z$ and piecing time $T_A$ determined by the desired piecing rpm $n_A$, will be too brief for correct execution of the sliver feed. The actual piecing time $T_A$ must then be correspondingly shifted, with the effect that the theoretically favorable piecing rpm $n_A$ will no longer be attainable. This problem is all the greater, the faster the spinning rotors run up to their operating speed: i.e., the steeper the slope of curves A and B. The invernal $t_2$ between the beginning of feed $T_Z$ and the desired piecing time $T_A$ is shortened still more. The slope of curves A and B depends essentially upon the weight of spinning rotors 7 and the drive power design. Especially, spinning rotors with small diameters lead to steep run up curves, particularly when the spinning machine and especially the rotor drive are so designed that spinning rotors with larger diameters and greater weight can be incorporated in the same spinning assembly. The drive power therefore must be designed to correspond to these spinning rotors.

Figure 3:
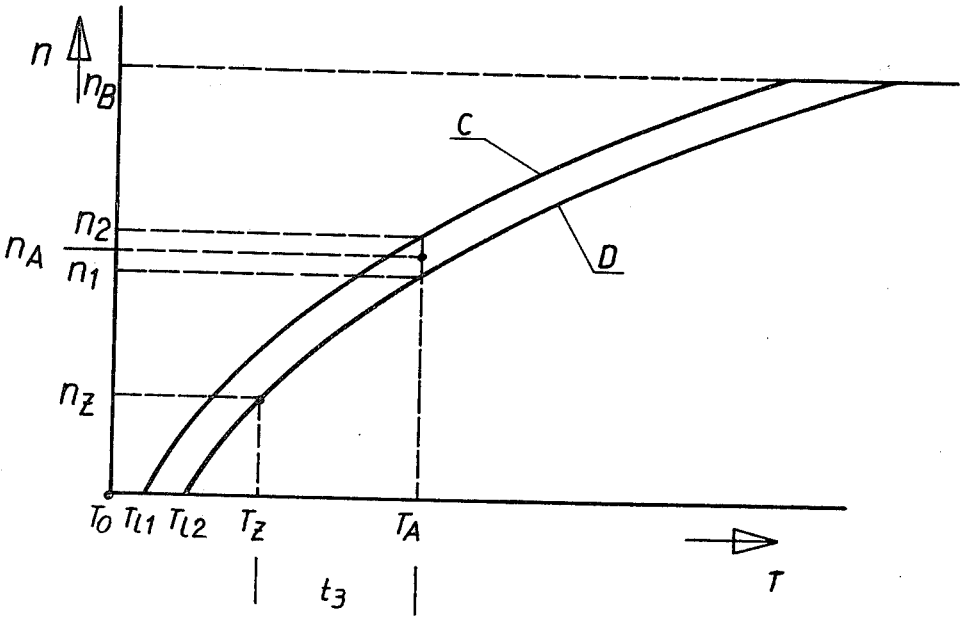
FIG. 3 is a diagram similar to FIG. 2, with running up behavior influenced by increasing the running up resistance, in accordance with preferred embodiments of the present invention.

To meet the difficulties that have been described, the running up behavior of spinning rotor 7 is influenced according to the invention in such a way that a longer interval between feed time $t_Z$ and the actual piecing time $T_A$ is obtained. In the embodiment of FIG. 3, this is managed by an arrangement whereby the slope of running up curves C and D of the spinning rotors is influenced: their speed is plotted over time T. When program control 53 gives the start signal to release the rotor brake at time $T_O$, it may be assumed that the actual release will occur between times $T_{L1}$ and $T_{L2}$. Spinning rotors 7 of the individual spinning assemblies run up to their operating speed according to a curve that is in the area between curves C and D. Because of the essentially flatter slope, the previously determined most favorable piecing speed $n_A$ is associated with a piecing time $T_A$, determined by the average between curves C and D, said time $T_A$ occurs in a substantially greater time interval with respect to starting time $T_0$. In this case also, there has to be a wait until a minimum rpm $n_z$ is reached, with sliver feed before the actual piecing (so-called preliminary feed). Time $T_Z$ for the feed is therefore determined from curve D, which shows the greatest deviation. It is obvious then that interval $t_3$ between feed time $T_Z$ and the desired piecing time $T_A$ will be substantially longer, and that it can be affected by the slope of curves C and D. The slope can be such that an adequate interval $t_3$ will be obtained for execution of the preliminary feed.

The flat slope of running up curves C and D then also has the advantage that, the possible deviations of rotor rpm's from the most favorable piecing speed $n_A$ are less, as $n_1$ and $n_2$ of FIG. 3 show, because the speed change per unit of time is less.

The reduction of the running up curve slope to an appropriate value can be managed in practice according to the invention by an arrangement whereby either the drive is influenced, or the running up resistance of the individual spinning rotors is increased. In open end spinning machines with a common drive for the spinning rotors of all spinning assemblies 2, the latter method is preferred. In this case, the mass inertia moment of the individual spinning rotors can be increased so that the running up time will be extended, and thereby the slope of running up curves C and D will be altered to the desired degree. Advantageously, using this idea as a basis, it can be provided that all spinning rotors will have the same design mass inertia moment according to FIG. 3, independently of their diameter or other configurations, so that there will be no difficulty for servicing instrument 52 in a change-over of the open end spinning machine. The servicing instrument can then also be used without further ado on adjacent open end spinning machines that work for example with other spinning rotors. The running up behavior and the slope of running up curves C and D can also be influenced as desired if during the running up a braking moment is exerted on rotor 7 or on its rotor shaft 8 which is less than the simultaneously acting drive torque.

Figure 4:
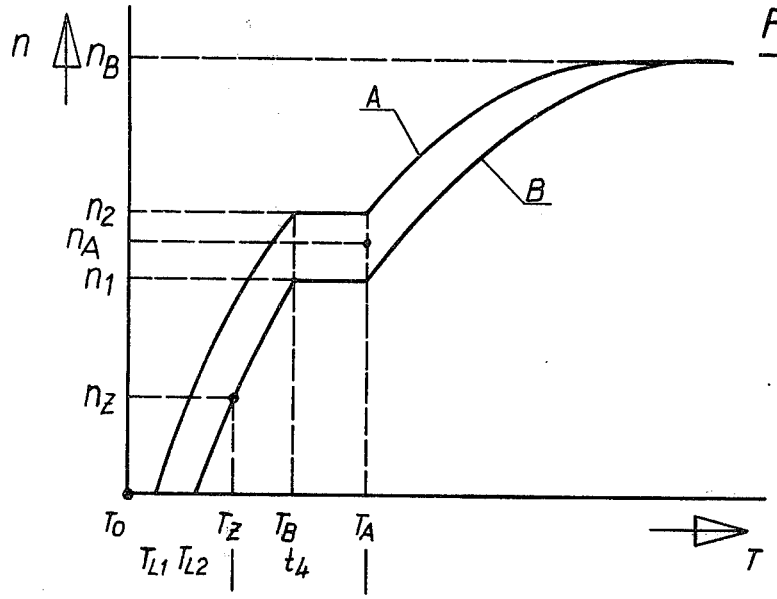
FIG. 4 is a diagram similar to FIG. 1, with running up behavior influenced by braking, in accordance with other preferred embodiments of the present invention.

FIG. 4 shows another possibility for influencing the running up behavior of spinning rotors 7 so that there will be enough time between the start of the preliminary feed and the piecing time, if a favorable piecing speed $n_A$ is to be associated with the piecing time, even if the slope of the running up (curve) is not affected. For this it is provided that a brake associated with spinning rotor 7 or its shaft 8 be actuated in the course of a quite specific interval during the running up phase. Here also it is to be assumed that the spinning rotors are running up to operational speed in a zone that is defined by parallel curves A and B corresponding to FIG. 2. To have enough time for execution of the preliminary feed, i.e. between starting time $T_Z$ for the preliminary feed and the actual piecing time $T_A$, it is provided that a brake associated with spinning rotor 7 will be actuated shortly after time $T_Z$, for example at time $T_B$.

The switching on of the brake occurs at a time $T_B$ which can be selected at an arbitrary point after $T_Z$. It may also be provided that braking time $T_B$ will be in the region which would correspond to piecing time $T_A$ as shown in FIG. 2, i.e. when the spinning rotor has about attained the desired piecing speed. It will then be advantageously provided that the brake will be released at the now freely selectable piecing time $T_A$ or later. Interval $t_4$ between time $T_Z$ at the beginning of the preliminary feed and actual piecing time $T_A$ is therewith freely selectable, by the duration of the actuation of the brake. It is advantageous if brakes are provided whose braking action can be very precisely regulated, particularly no-contact magnetic or electric brakes. These brakes have the advantage that not only is their action very precisely regulated, but also their switching times. In this kind of extension of the running up phase, only the time interval $t_4$ is influenced by non-uniform places in curves A and B, but the range of tolerance between speed $n_1$ and $n_2$ is not affected. Switching on of the brake can therefore occur at any time $T_B$ between the beginning of sliver feed and the actual piecing time without anything being basically changed.

Figure 5:
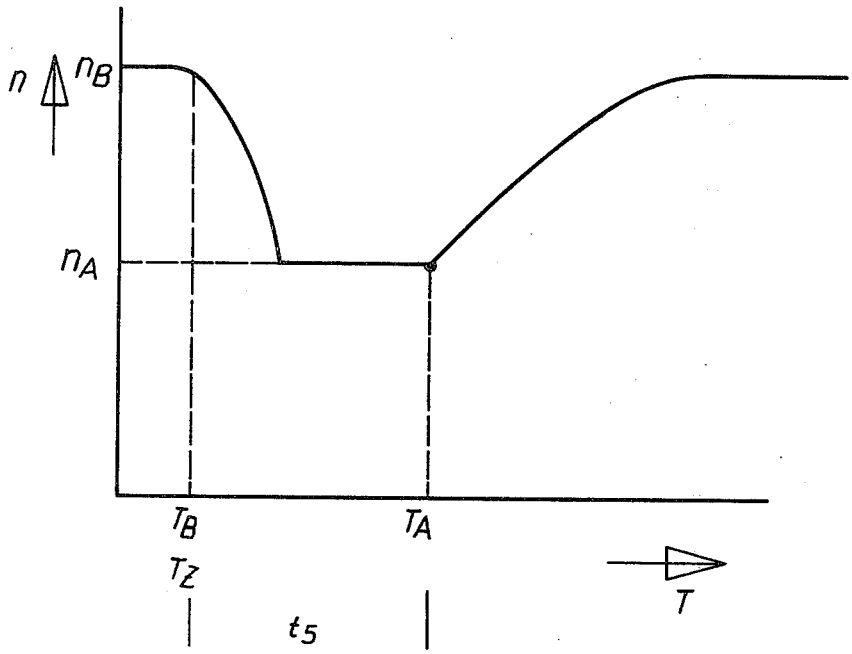
FIG. 5 is a diagram of the course of the rpm of a spinning rotor, braked for execution of a piecing operation, in accordance with yet other preferred embodiments of the present invention.

The possibility shown in FIG. 5, where again rotor rpm n is plotted over time T, differs from the arrangements described above in that the spinning rotor has already reached its operational speed $n_B$ before the actual piecing time $T_A$, and in that it is braked down to a favorable piecing speed $n_A$. In this case the interval $t_5$ between the start $T_Z$ of the sliver feed and the actual piecing time $T_X$ can be selected arbitrarily because the spinning rotor always has a speed that suffices for production of an acceptable sliver ring. Only for example time $T_Z$ in FIG. 5 is shown to coincide with time $T_B$ at which the braking process is begun. It is possible this way to run up piecing speed $n_A$ very precisely, whereby the precision depends only on the precise effect of the brake because the start is from operational speed $n_B$ which can be regarded as the same on practically all spinning assemblies. There are intrinsically no difficulties with known working outputs and given conditions, in designing a brake, especially a no-contact magnetic or electric brake, in such a way that it will be possible to brake down to a quite specific rpm.

If the braking action cannot be adjusted with extreme precision, a combination of FIGS. 3 and 4 can be advantageous, for example. Here there will be braking down from the operational rpm $n_B$ of the spinning rotor to a speed that is clearly below the desired piecing speed $n_A$ but above the minimum necessary rpm $n_z$ for sliver feed, and then it will be provided at the same time that the brake will be released before the actual piecing time $T_A$ so that the yarn will be pieced during the running up. It is then advantageous if running up curves with a flat slope are provided, in which there are only small changes of rotor speed in the course of a unit of time.

Figure 6:
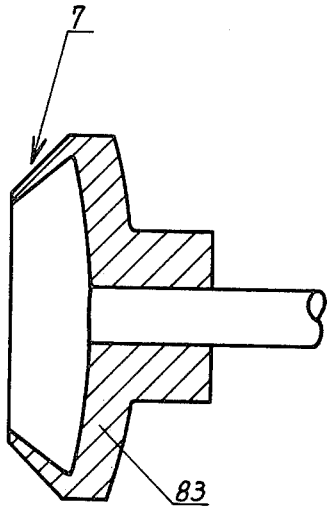
FIGS. 6 to 9 are axial sections through open end spinning rotors with means for influencing the running up behavior, by increasing the mass inertia moment, in accordance with preferred embodiments of the invention.

FIG. 6 shows a spinning rotor 7 with a relatively small external diameter whose running up curve, insofar as no special measures are undertaken, would have a characteristic according to curves A, B of FIG. 2. To give spinning rotor 7 of FIG. 6 a running up behavior such that curve C, D of FIG. 3 would be obtained, back wall 83 is thickened, clearly beyond what would be required for reasons of strength. This not only increases the weight of spinning rotor 7 but also advantageously increases its mass inertia moment, which is governing for its running up behavior. Material consumption for a spinning rotor 7 with thickened back wall 83 is not any greater, because spinning rotor 7 is customarily machined from a solid piece. Since moreover the external diameter of spinning rotor 7 is unchanged, its air resistance after operational speed $n_B$ is reached remains essentially constant, whereby power consumption in the operational state is practically speaking not increased.

Figure 7:
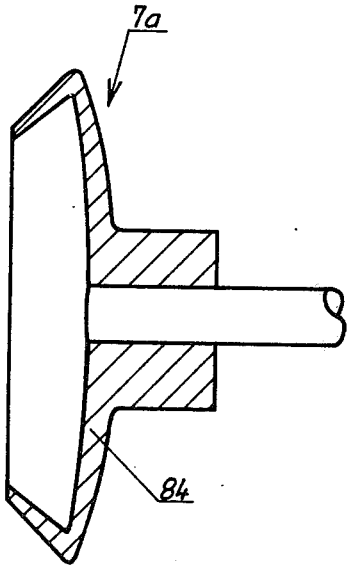

FIG. 7 shows a spinning rotor 7*a* which has a larger diameter, in comparison to spinning rotor 7 of FIG. 6. It is advantageous that the inertia moment of spinning rotor 7*a* be balanced with the inertia moment of spinning rotor 7 because then the program control of servicing instrument 52 will be independent of the diameter of the individual spinning rotors. This means that back wall 84 of spinning rotor 7*a* will be substantially thinner than back wall 83 of spinning rotor 7.

Figure 8:
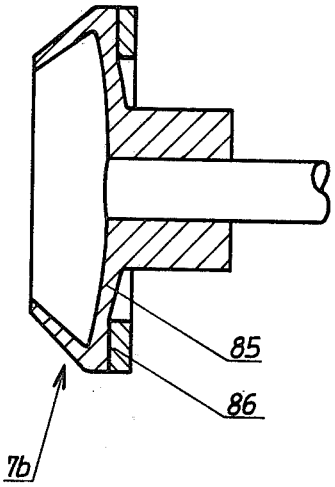
Figure 9:
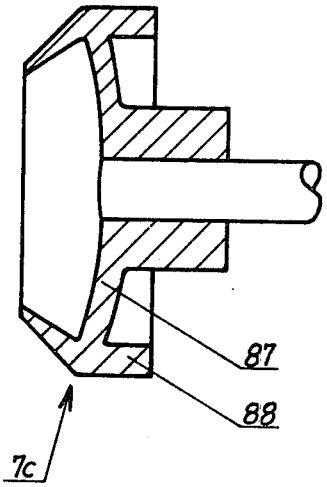

In the embodiments of FIGS. 8 and 9, other measures are shown, whereby in spinning rotors 7*b* and 7*c* which have a small diameter, the inertia moment can be increased. In the embodiment according to FIG. 8, a pressed on steel ring 86 is provided on back wall 85 (which in itself is thin) of spinning rotor 7*b*, in the external zone that is important for the inertia moment. Here again air resistance of spinning rotor 7*b* is not increased, practically speaking. The measurements of ring 86 can be selected according to the respective diameters of the spinning rotors that the total inertia moments will remain essentially constant. Insofar as machining from the solid is provided, according to FIG. 9 the spinning rotor 7*c* can also have its inertia moment increased, in that a material ring 88 will be left in the region of the outer diameter, on thin wall 87, said ring being integral with the rest of spinning rotor 7*c*.

Figure 10:
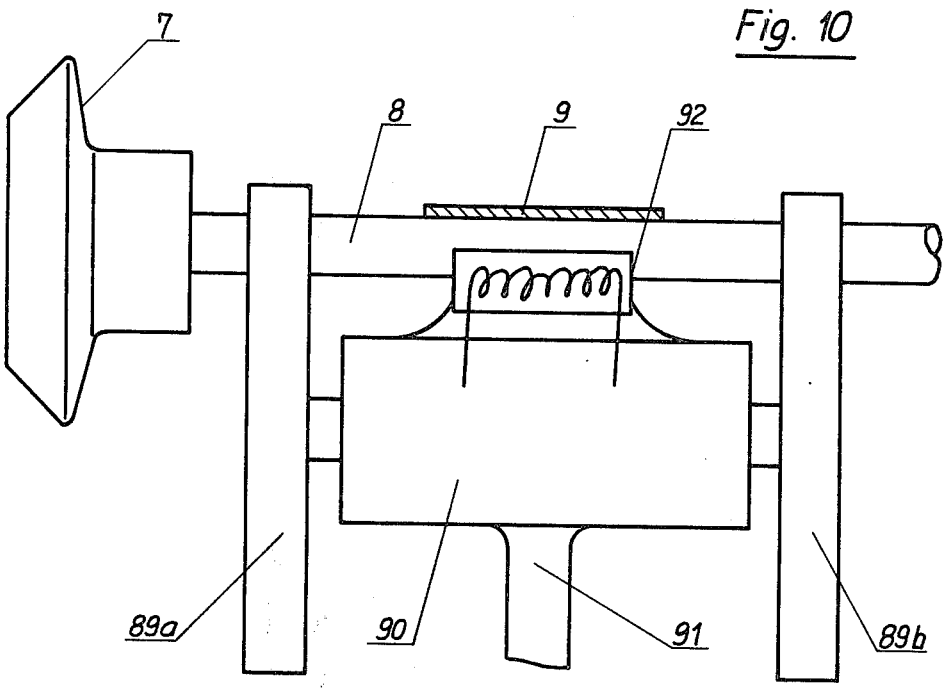
FIGS. 10 and 11 schematically show electromagnetic braking and delay elements in conjunction with open end spinning rotors, in accordance with preferred embodiments of the invention.
Figure 11:
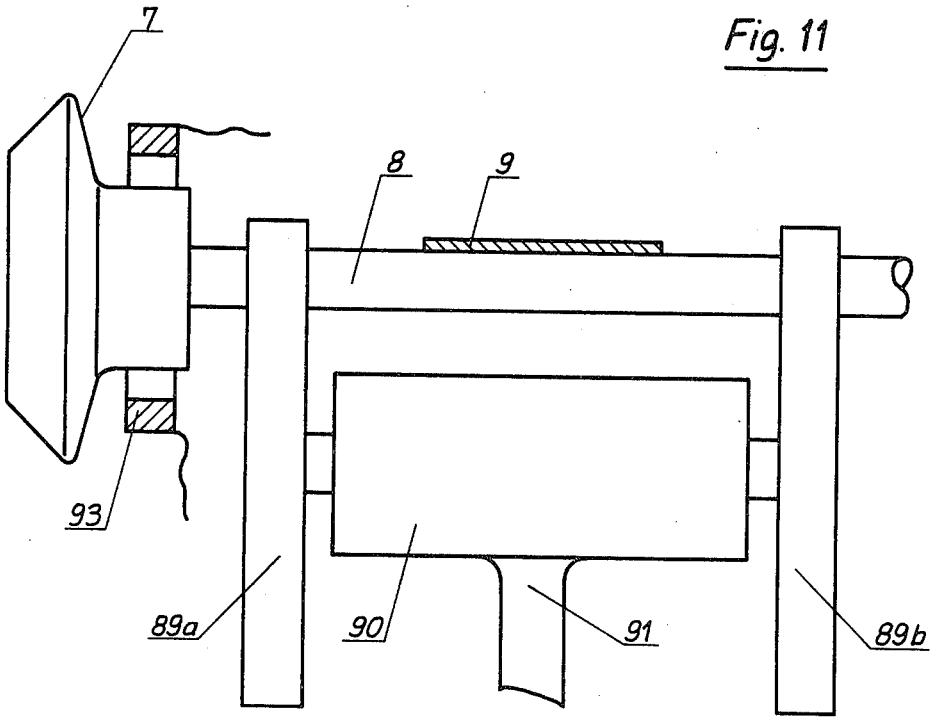

FIGS. 10 and 11 show how the running up behavior of a spinning rotor 7 can be influenced without changing the inertia moment itself. In both examples of embodiment, shaft 8 of spinning rotor 7 is borne in the wedge gap of guide roller pairs 89*a*, *b* and driven directly by a tangential belt 9. Guide roller pairs 89*a*, are in turn received by bearings 90 which are disposed on a retaining device 91. In the embodiment according to FIG. 10 there is ann electromagnet 92 in the region of rotor shaft 8. This magnet, advantageously switched by mobile servicing instrument 52, is switched on only during the running up phase of spinning rotor 7. In this way electromagnet 92 works like a brake, which has the result that there is a flat running up curve C, D according to FIG. 3. As FIG. 11 shows, it is also contemplated to use such an electromagnet 93 also in the region of spinning rotor 7, and to influence it.

Figure 12:
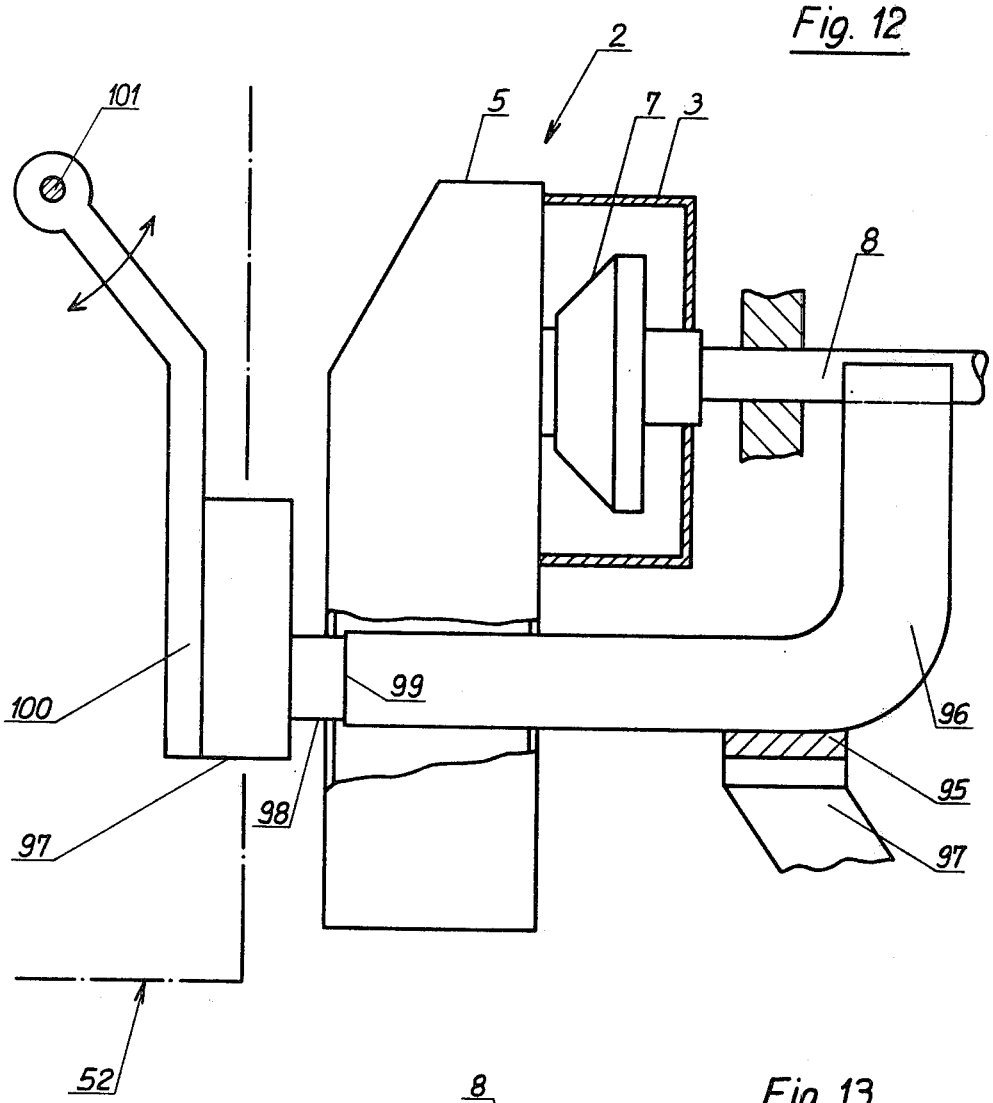
FIG. 12 schematically shows an open end spinning assembly with a magnetic brake that is actuatable by a mobile servicing instrument, in accordance with a preferred embodiment of the invention.
Figure 13:
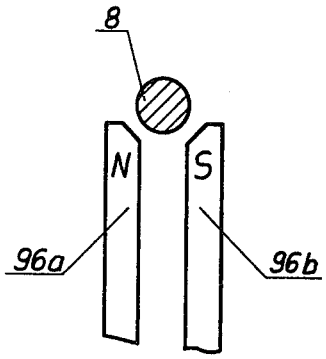
FIG. 13 is an enlarged view showing a detail of FIG. 12, seen in the direction of the shaft of the open end spinning rotor.

Housings 3 and 5 of open end spinning assembly 2 are only shown schematically in FIG. 12. In order to influence the running up curve of spinning rotor 7, there are pole shoes 96 in the region of rotor shaft 8 in each individual spinning assembly. As indicated in the section shown in FIG. 13, two pole shoes 96*a* and 96*b* are provided, whereof one is north and the other south. We see from FIG. 12 that pole shoes 96 are disposed on a retaining device 94 with insulation 95. Numeral 52 indicates the dot-and-dash contour of a mobile servicing instrument which presents a lever 100 that can be swung about a shaft 101, said lever bearing an electromagnet 97. This electromagnet 97 also has pole shoes 98 which can be presented to pole shoes 96 as the result of a swinging movement about shaft 101. During the high-speed running of spinning rotor 7, pole shoes 96 of spinning assembly 2 form, as it were, an extension of pole shoes 98 of servicing instrument 52. Pole shoes 96 are preferably held with slight resilience so that at the point of contact 99 there will be no air gap. Electromagnet 97 is only actuated in the running up of spinning rotor 7, while its pole shoes 98 are not in contact with pole shoes 96 the rest of the time. In this way the running up time of spinning rotor 7 can be extended on purpose. Obviously, with appropriate actuation, characteristics as shown in FIG. 4 or 5 can be produced.

Figure 14:
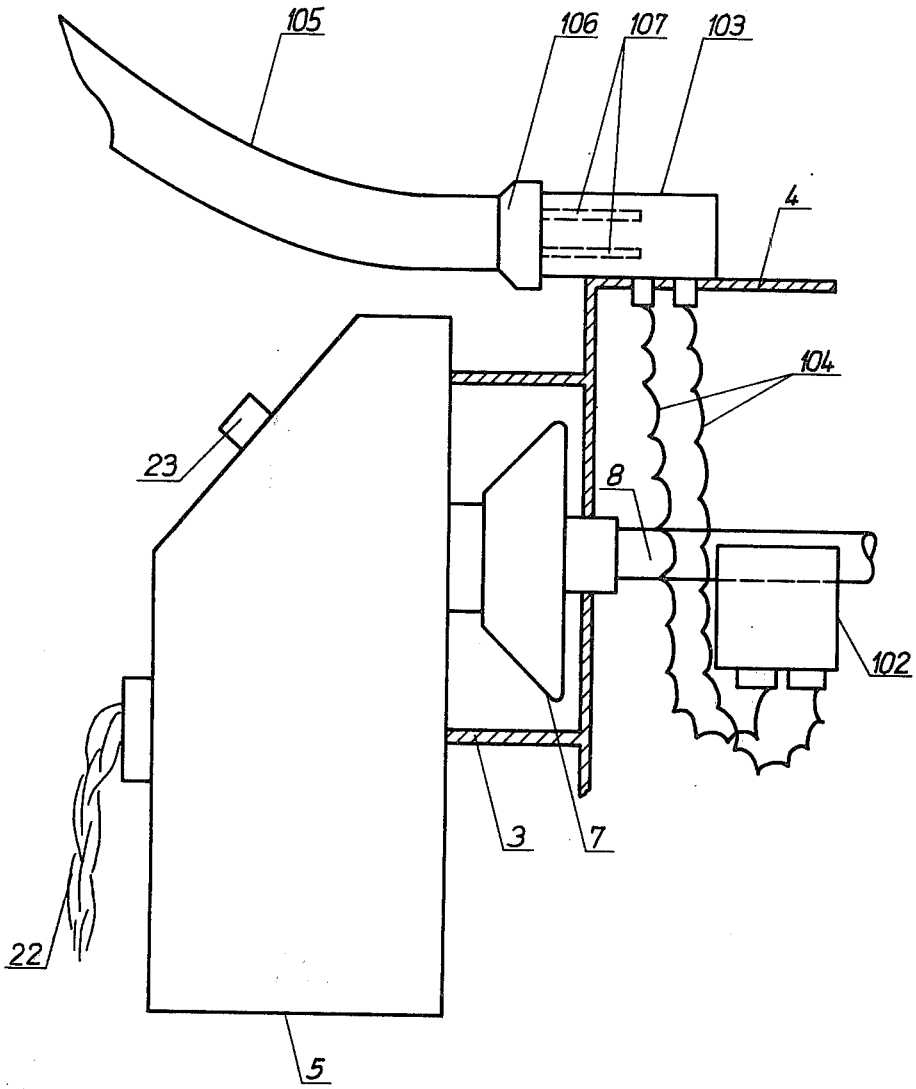
FIG. 14 schematically shows an open end spinning assembly with an electric brake, actuatable by a mobile servicing instrument, in accordance with a preferred embodiment of the invention.

In FIG. 14, in addition to housing 3, a part of housing 4 for rotor shaft 8 is shown, as well as the schematically indicated housing 5, whereon the issuing yarn take-off passage 23 and the entering sliver 22 are shown. In the region of shaft 8 of spinning rotor 7, there is an eddy current brake 102 which can be energized by a mobile servicing instrument, which is not shown in FIG. 14. This occurs in the running up phase of spinning rotor 7, and serves to extend the running up time (FIG. 3) or only a segment of the running up time (FIG. 4), or to brake down the spinning rotor from its operational speed (FIG. 5). The eddy current brake 102, disposed on each spinning assembly, is connected via electric leads 104 with a plug receptacle 103, in which a plug 106 with its contacts 107 can be inserted. Plug 106 is a component of a swing arm 105 of the servicing instrument which is not illustrated. It is also possible, instead of plug receptacle 103, to provide a switch that is actuated by the swing arm of the servicing instrument. In this case the eddy current brake has to be connected to a supply lead of the spinning machine. Such a switch can also be manually actuated, if the advantage of the relatively lower piecing speed is to be made use of in manual piecing.

Figure 15:
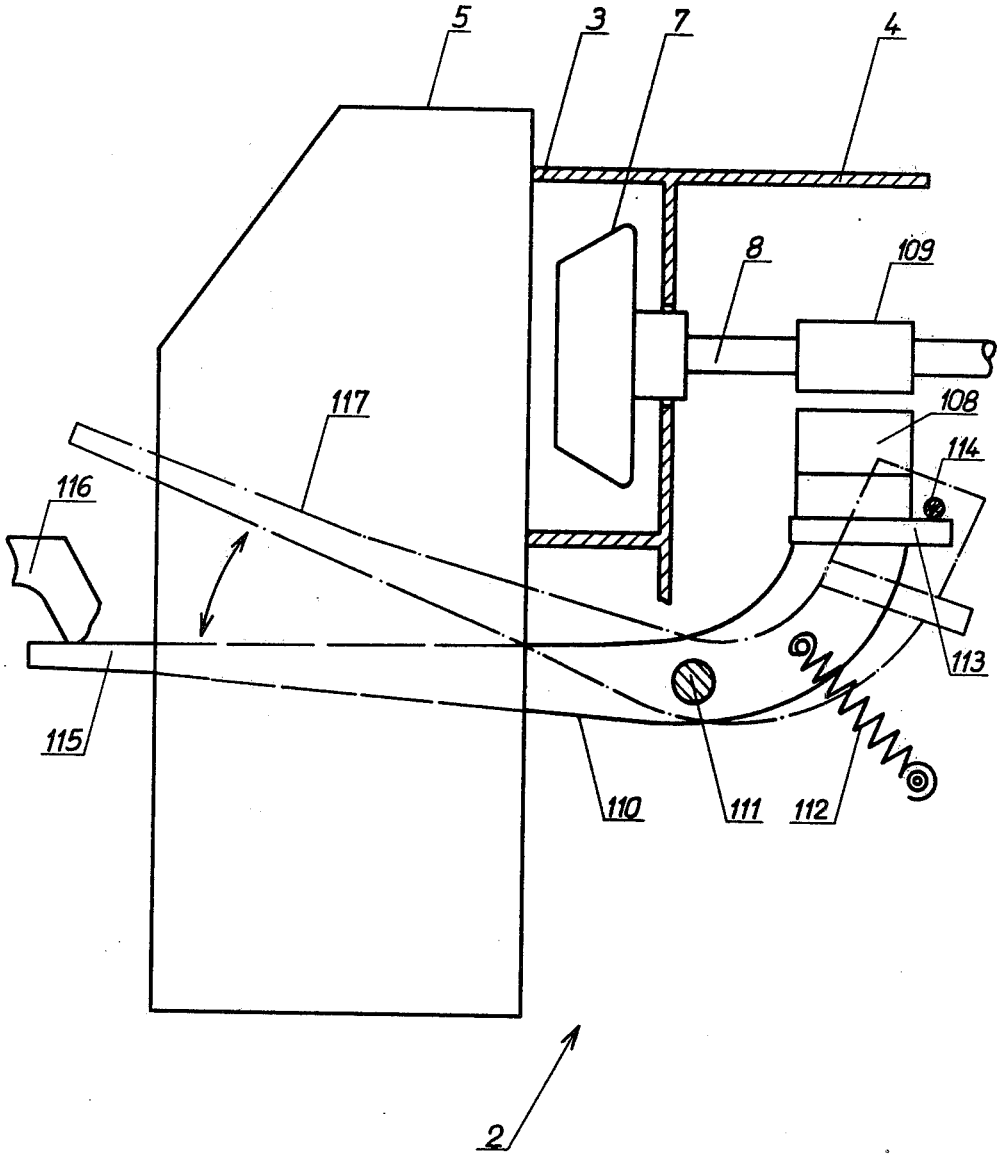
FIG. 15 shows another embodiment of the invention with a magnetic brake.

In the arrangement of FIG. 15, a permanent magnet 108 is provided as braking or delaying element, to extend the running up time of spinning rotor 7, said magnet being such that it can be presented to an annular collar 109 on rotor shaft 8 during the running up phase of spinning rotor 7. Permanent magnet 108 is disposed for this on a double lever 110 that is swingable about shaft 111, fixed to the machine, said lever extending forward beyond housing 5 with an extension 113. A corresponding swingable lever 116 of the servicing instrument which is not illustrated can force the lever out of its normal position 117 (dot-and-dash), into its position 110, whereby the permanent magnet is presented to annular collar 109. This motion is limited by a stationary stop 114 against which extension 113 of double armed lever 110 can be applied. As soon as lever 116 of the servicing instrument again releases lever 115, the latter will again swing into its position 117, urged by tension spring 112.

Figure 16:
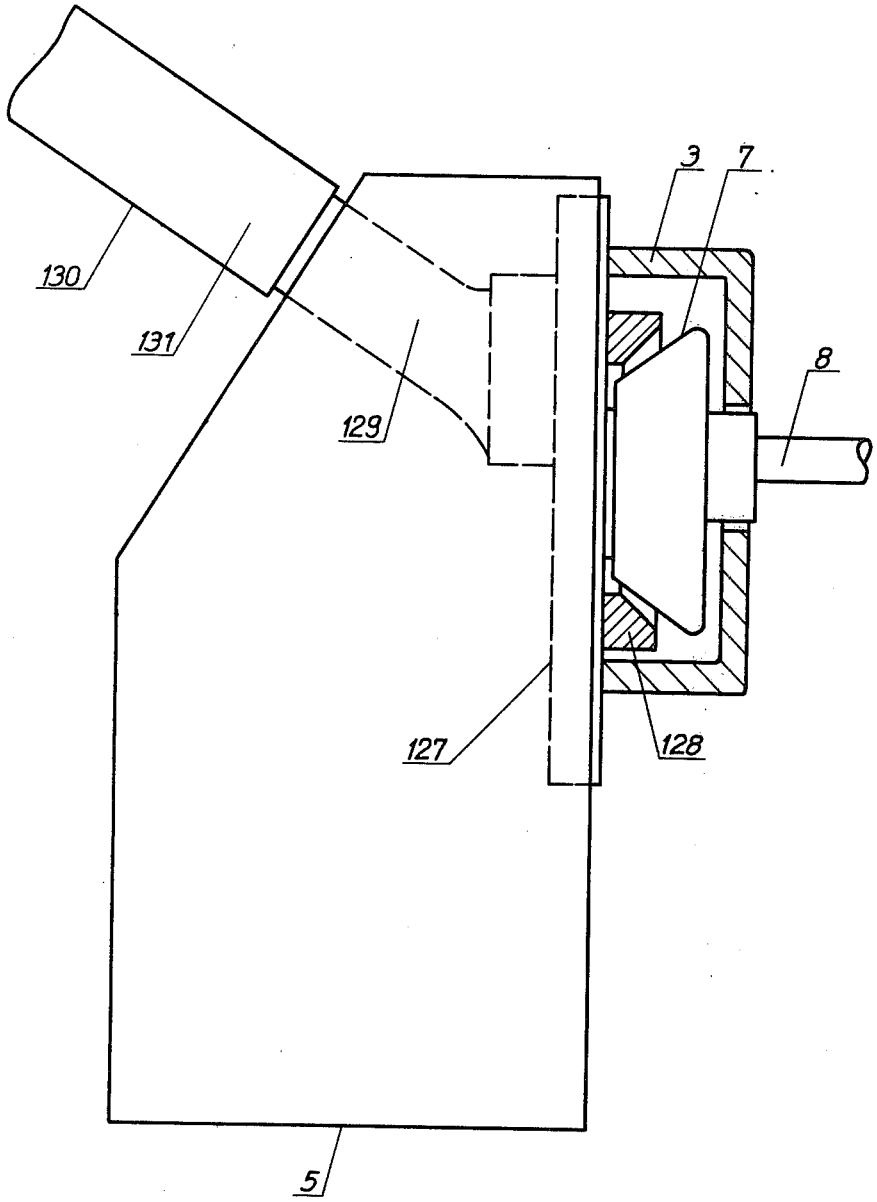
FIG. 16 schematically shows another embodiment of the invention, using an eddy current braking device.

FIG. 16 shows a further development whereby the running up behavior or anyhow the running of spinning rotor 7 can be influenced by an eddy current brake 129. Inside housing 3, for this purpose, there are fixed pole shoes 128 of an eddy current brake. This arrangement can be such that pole shoes 128 will be disposed on the so-called channel plate 127 which is part of swingable housing 5. An operating arm 130 of the servicing instrument which is not illustrated energizes eddy current brake 129 so that pole shoes 128 act on spinning rotor 7. The line of separation between eddy current brake 129 and swing arm 130 is designated 131.

Figure 17:
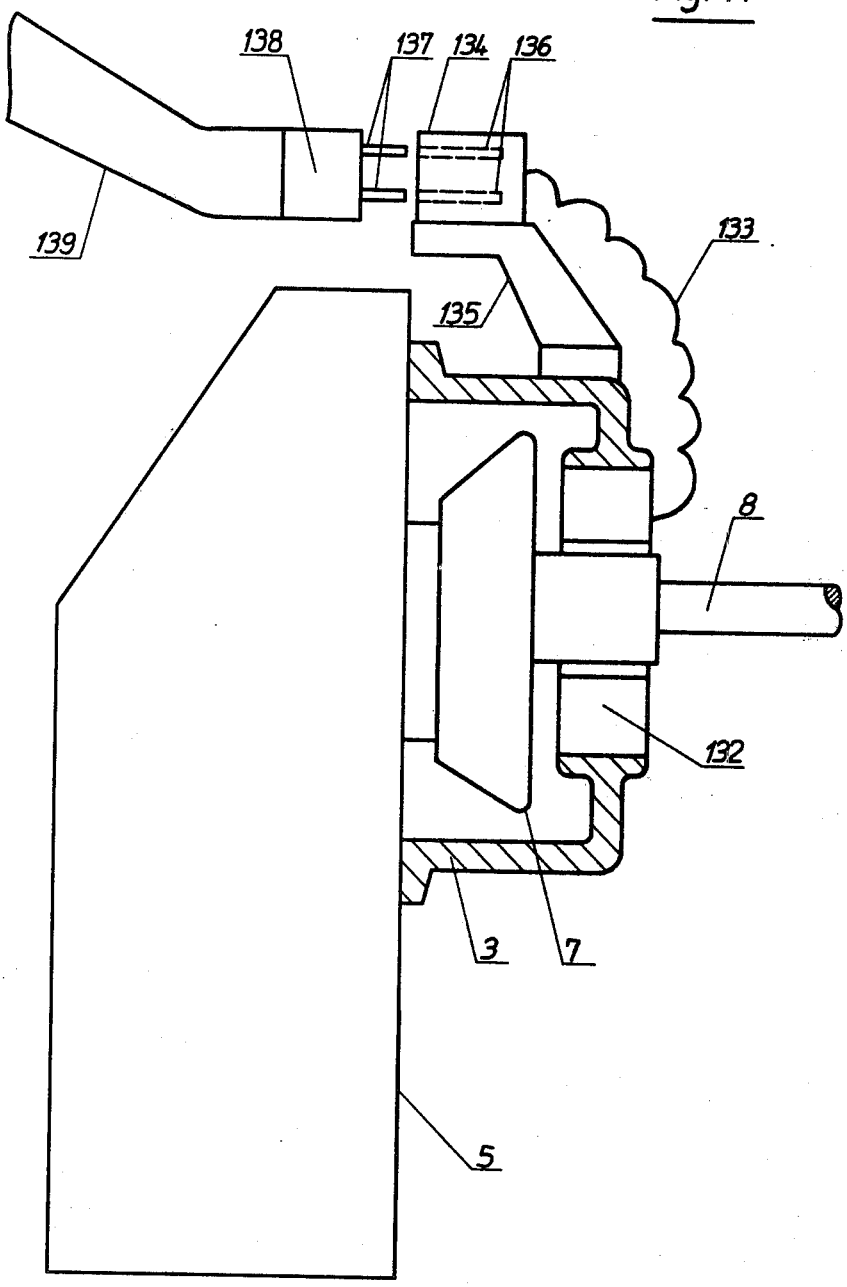
FIG. 17 schematically shows an open end spinning assembly with an electromagnetic brake actuatable by a servicing instrument, in accordance with yet another preferred embodiment.

In the embodiment according to FIG. 17, a coil 132 of an eddy current brake is disposed immediately behind spinning rotor 7 about rotor shaft 8, or fixedly disposed about an annular collar of the spinning rotor. It can be incorporated in housing 3. Coil 132 is connected via an electric lead 133 with a plug receptacle 134, in whose receivers 136 the corresponding contacts 137 of a plug 138 can be placed. Plug 138 is disposed on a swingable arm 139 of a servicing instrument which is not illustrated. Here also, similarly to the case of the embodiment of FIG. 14, instead of a plug receptacle there may be a switch that can be actuated by the swingable arm.

The possibility of extending the running up time of spinning rotor 7, or the time between the preliminary feed and favorable piecing speed, can also be utilized if there is to be manual piecing. Moreover, it is also contemplated to use this procedure in collective piecing, in which for example all spinning assemblies are to be run up at once when the machine is started up.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. In a process for piecing a yarn on spinning assemblies of an open end spinning machine including:
- preparing a yarn end,
- producing a sliver ring in a spinning rotor of the spinning assembly,
- guiding said yarn end into said spinning rotor,
- applying said yarn end to said silver ring in the spinning rotor during acceleration of the spinning rotor toward its operational spinning speed,
- and drawing off of the new yarn;
- the improvement comprising:
  - controlling the acceleration behavior of the spinning rotor to extend the time segment in which there are suitable piecing rotor speeds during said acceleration for performing said producing a sliver ring, applying said yarn end, and drawing off of the new yarn, said suitable rotor speed being lower than the normal operational spinning speed of said rotor, wherein the spinning rotor is one of a plurality of spinning rotors driven by a common drive means, and wherein said controlling the acceleration behavior of the spinning rotor is accomplished independently of the acceleration behavior of other commonly driven spinning rotors.

2. Process according to claim 1, wherein said controlling of the acceleration behavior includes controlling of the driving means for the rotor so as to slow the acceleration of the rotor as it passes through suitable rotor speeds for performing application of said yarn end to said silver ring and drawing off of the new yarn.

3. Process according to claim 1, further comprising applying braking forces to a rotor operating at normal operational speed to reduce said rotor speed down to a predetermined suitable rotor speed for piecing.

4. Process according to claim 1, further comprising applying braking forces to a rotor operating at normal operational speed to reduce said rotor speed to a value above the minimum necessary sliver feeding speed for forming a sliver ring in said rotor, wherein said controlling of the acceleration behavior includes release of the braking forces subsequent to formation of said sliver ring and preliminary to said applying of said yarn end to said sliver ring.

5. Process according to claim 1, wherein said controlling of the acceleration behavior includes providing a plurality of different size interchangeable spinning rotors with similar mass inertia moments, whereby the slope of the acceleration curves of the spinning rotors from a braked condition to suitable piecing rotor speeds are similar for different diameter spinning rotors.

6. Process according to claim 1, wherein said controlling of the acceleration behavior includes application of braking forces on said rotor which are smaller than simultaneously applied drive forces.

7. In a process for piecing a yarn on spinning assemblies of an open end spinning machine including:
- preparing a yarn end,
- producing a sliver ring in a spinning rotor of the spinning assembly,
- guiding said yarn end into said spinning rotor,
- applying said yarn end to said sliver ring in the spinning rotor,
- and drawing off of the new yarn;
- the improvement comprising:
  - controlling the acceleration behavior of the spinning rotor to extend the time segment in which there are suitable piecing rotor speeds for performing said producing a sliver ring, applying said yarn end, and drawing off of the new yarn, said suitable rotor speed being lower than the normal operational spinning speed of said rotor,
  - wherein said controlling of the acceleration behavior includes providing a plurality of different size interchangeable spinning rotors with similar mass inertia moments, whereby the slope of the acceleration curves of the spinning rotors from a braked condition to suitable piecing rotor speeds are similar for different diameter spinning rotors.

8. In a process for piecing a yarn on spinning assemblies of an open end spinning machine including:
- preparing a yarn end,
- producing a sliver ring in a spinning rotor of the spinning assembly,
- guiding said yarn end into said spinning rotor,
- applying said yarn end to said sliver ring in the spinning rotor,
- and drawing off of the new yarn;
- the improvement comprising:
  - controlling the acceleration behavior of the spinning rotor to extend the time segment in which there are suitable piecing rotor speeds for performing said producing a sliver ring, applying said yarn end, and drawing off of the new yarn, said suitable rotor speed being lower than the normal operational spinning speed of said rotor,
  - wherein said controlling of the acceleration behavior includes application of braking forces on said rotor which are smaller than simultaneously applied driving forces.

9. Process according to claim 8, wherein said braking forces are applied by electromagnetic braking means.

10. Process according to claim 8, wherein said braking forces are applied by selectively movable permanent magnet means.

11. Process according to claim 8, wherein said braking forces are applied by eddy current braking means.

12. Apparatus for piecing a yarn on spinning assemblies of an open-end spinning machine comprising:

yarn end preparing means for preparing a yarn end to be pieced to new yarn being formed at a spinning rotor of a spinning assembly, sliver ring producing means for producing a sliver ring in the spinning rotor, common drive means for rotatably driving a plurality of spinning rotors, yarn end applying means for applying said yarn end to said sliver ring to initiate piecing of said yarn end to new yarn being formed at said sliver ring during acceleration of the spinning rotor toward its normal operational speed, drawing means for drawing off said yarn end and new yarn pieced thereto, and control means for controlling the acceleration behavior of the spinning rotor independently of commonly driven spinning rotors to extend the time segment in which there are suitable piecing rotor speeds for accommodating piecing of said yarn end with said sliver ring, said suitable piecing rotor speeds being lower than the normal operational spinning speed of said spinning rotor.

13. Apparatus according to claim 12, wherein said control means includes driving control means for controlling driving means for said rotor so as to slow the acceleration of the rotor as it passes through said suitable rotor speeds for piecing.

14. Apparatus according to claim 12, further comprising braking means for reducing the rotor speed from an operational spinning speed to said suitable rotor speeds.

15. Apparatus according to claim 12, further comprising braking means for applying braking forces to a rotor operating at normal operational spinning speeds to reduce said rotor speed to a value above the minimum necessary sliver feeding speed for forming a sliver ring in said rotor, said control means further including means for releasing said braking means subsequent to formation of said sliver ring and preliminary to application of said yarn end to said sliver ring by said yarn end applying means.

16. Apparatus according to claim 12, wherein said control means includes a plurality of different size interchangeable spinning rotors provided with similar mass inertia moments, whereby the slope of the acceleration curves of the spinning rotor from a braked condition to suitable piecing rotor speeds are similar for different diameter spinning rotors.

17. Apparatus according to claim 12, wherein said control means includes braking means for applying braking forces on said rotor simultaneously with application of driving forces thereto during acceleration of said rotor through said suitable piecing rotor speeds, said braking forces being smaller than said driving forces.

18. Apparatus for piecing a yarn on spinning assemblies of an open-end spinning machine comprising:

yarn end preparing means for preparing a yarn end to be pieced to new yarn being formed at a spinning rotor of a spinning assembly, sliver ring producing means for producing a sliver ring in the spinning rotor, yarn end applying means for applying said yarn end to said sliver ring to initiate piecing of said yarn end to new yarn being formed at said sliver ring, drawing means for drawing off said yarn end and new yarn pieced thereto, and control means for controlling the running up behavior of the spinning rotor to extend the time segment in which there are suitable piecing rotor speeds for accommodating piecing of said yarn end with said sliver ring, said suitable piecing rotor speeds being lower than the normal operational spinning speed of said spinning rotor, wherein said control means includes a plurality of different size interchangeable spinning rotors provided with similar mass inertia moments, whereby the slope of the acceleration curves of the spinning rotor from a braked condition to suitable piecing rotor speeds are similar for different diameter spinning rotors.

19. Apparatus for piecing a yarn on spinning assemblies of an open-end spinning machine comprising:

yarn end preparing means for preparing a yarn end to be pieced to new yarn being formed at a spinning rotor of a spinning assembly, sliver ring producing means for producing a sliver ring in the spinning rotor, yarn end applying means for applying said yarn end to said sliver ring to initiate piecing of said yarn end to new yarn being formed at said sliver ring, drawing means for drawing off said yarn end and new yarn pieced thereto, and control means for controlling the running up behavior of the spinning rotor to extend the time segment in which there are suitable piecing rotor speeds for accommodating piecing of said yarn end with said sliver ring, said suitable piecing rotor speeds being lower than the normal operational spinning speed of said spinning rotor, wherein said control means includes braking means for applying braking forces on said rotor simultaneously with application of driving forces thereto during acceleration of said rotor through said suitable piecing rotor speeds, said braking forces being smaller than said driving forces.

20. Apparatus according to claim 19, wherein said braking means includes non-contact electromagnetically operated brakes.

21. Apparatus according to claim 19, wherein said braking means includes non-contact movable permanent magnet brake means.

22. Apparatus according to claim 19, wherein said braking means includes eddy current braking means.

23. Open-end spinning machine apparatus comprising:

a plurality of spinning assemblies each including a spinning rotor, starter sliver ring producing means for producing a starter sliver ring in respective ones of said spinning rotors, yarn end applying means for applying a yarn end to the sliver ring to effect a piecing of said yarn end with newly formed yarn at said sliver ring, yarn draw off means for drawing off said yarn end and said newly formed yarn, braking means for reducing the speed of said rotor to pre-piecing speeds substantially slower than normal operational spinning speeds of said rotor before a piecing operation, trigger means to initiate the acceleration of said spinning rotor from said pre-piecing speeds toward said normal operational spinning speed, said braking means and trigger means being actuable in succession in order to accommodate the sequential production of the starting sliver ring, application of the yarn end to the sliver ring, and withdrawal of the newly formed yarn, all at speeds below said normal operational spinning speed, and control means for influencing the time interval between the reduction of the speed of said rotor to pre-piecing speeds and the acceleration of said rotor to said operational spinning speeds, wherein said control means includes supplementing weights given to respective spinning rotors to increase the mass inertia moment thereof.

24. Apparatus according to claim 23, wherein the weights which increase the mass inertia moment are formed integrally on the respective spinning rotors.

25. Apparatus according to claim 23, wherein the weights which increase the mass inertia moment are supplementary parts connected with the spinning rotors so as to be fixed in rotation therewith.

26. Apparatus according to claim 23, wherein the mass inertia moments of all spinning rotors are such that the spinning rotors present the same mass inertia moment, independently of their dimensions which depend upon desired spinning conditions.

27. Apparatus according to claim 23, wherein said control means includes braking and delaying elements for the spinning rotors which can be switched on during the piecing process, said elements comprising braking means that can be presented to the spinning rotor or a rotor shaft, adjusted to a given braking moment which is less than the simultaneously applied drive torque.

28. Apparatus according to claim 23, wherein a servicing instrument equipped with means for execution of the work steps necessary for the piecing operation is provided, having means for switching on or actuating braking or delaying elements which are controlled by a program control that controls the whole piecing operation.

29. Apparatus according to claim 28, wherein the program control controls the switching on or the actuation of the braking or delaying members as a function of time.

30. Apparatus according to claim 28, wherein the program control is connectible with a tachometer associated with the spinning rotors and controls the switching on or the actuation of the braking or delaying elements and the means for execution of the subsequent work steps as a function of a predetermined rpm of the spinning rotor of the spinning assembly which is to be serviced.

31. Open-end spinning machine apparatus comprising:

a plurality of spinning assemblies each including a spinning rotor, starter sliver ring producing means for producing a starter sliver ring in respective ones of said spinning rotors, yarn end applying means for applying a yarn end to the sliver ring to effect a piecing of said yarn end with newly formed yarn at said sliver ring, yarn drawn off means for drawing off said yarn end and said newly formed yarn, braking means for reducing the speed of said rotor to pre-piecing speeds substantially slower than normal operational spinning speeds of said rotor before a piecing operation, trigger means to initiate the acceleration of said spinning rotor from said pre-piecing speeds toward said normal operational spinning speed, said braking means and trigger means being actuable in succession in order to accommodate the sequential production of the starting sliver ring, application of the yarn end to the sliver ring, and withdrawal of the newly formed yarn, all at speeds below said normal operational spinning speed, and control means for influencing the time interval between the reduction of the speed of said rotor to pre-piecing speeds and the acceleration of said rotor to said operational spinning speeds, wherein said control means includes braking and delaying elements for the spinning rotors which can be switched on during the piecing process, said elements comprising braking means that can be presented to the spinning rotor or a rotor shaft, adjusted to a given braking moment which is less than the simultaneously applied drive torque.

32. Apparatus according to claim 31, wherein mechanical braking means are associated with the rotor shafts.

33. Apparatus according to claim 31, wherein said control means includes one of no-contact magnetic and electric braking means associated with one of the spinning rotors and rotor shafts attached thereto.

34. Apparatus according to claim 32, wherein each spinning assembly is equipped with braking or delaying elements that are actuable from the outside when the spinning assembly is closed.

35. Apparatus according to claim 33, wherein said braking means are actuable from the outside when the spinning assembly is closed to effect normal operational spinning.

36. Apparatus according to claim 34, wherein a servicing instrument equipped with means for execution of the work steps necessary for the piecing operation is provided, having means for switching on or actuating braking or delaying elements which are controlled by a program control that controls the whole piecing operation.

* * * * *